United States Patent [19]

VonHeck

[11] 4,114,214

[45] Sep. 19, 1978

[54] SUPER-CONFORMING SEATING SYSTEM

[76] Inventor: Robert VonHeck, 3910 Hicock St., San Diego, Calif. 92110

[21] Appl. No.: 698,719

[22] Filed: Jun. 21, 1976

[51] Int. Cl.[2] ..... A47C 27/00

[52] U.S. Cl. ..... 5/367; 5/91; 297/284

[58] Field of Search ..... 297/284, 458–460, 297/DIG. 1, DIG. 3; 5/361, 345, 365, 367–370, 91; 161/160

[56] References Cited

U.S. PATENT DOCUMENTS

| | | | |
|---|---|---|---|
| 3,192,541 | 7/1965 | Moore | 297/284 |
| 3,382,511 | 5/1968 | Brooks | 5/361 R |
| 3,477,071 | 11/1969 | Emerson | 297/284 |
| 3,608,961 | 9/1971 | Von Heck | 5/361 R |
| 3,616,171 | 10/1971 | Hoskinson | 5/361 R |
| 3,616,471 | 11/1971 | Braun | 5/367 |
| 3,629,882 | 12/1971 | Thorne | 5/361 R |
| 3,840,920 | 10/1974 | Voelker | 5/368 |

*Primary Examiner*—Casmir A. Nunberg
*Attorney, Agent, or Firm*—Frank D. Gilliam

[57] ABSTRACT

An improved variable contour cushion operating system comprising an imperforate flexible casement containing myriad amounts of tiny spherical plastic micro-bearings which displace in response to an occupants body weight during an equalized atmospheric-pressure mode of use, but respond enmasse to an induced low-pressure air differential condition by fixing to an instant position through virtue of said micro-bearings deforming temporarily into inter-joining polyhedrons; wherein said casement in this new disclosure is additionally subjected to a "floative"-mode of operation involving positive air-pressure greater than former ambient-atmosphere, thus achieving an enhanced cradling effect in the "contour"-mode for greater comfort & security to the occupant.

10 Claims, 2 Drawing Figures

SUPER-CONFORMING SEATING SYSTEM

ORIGIN OF DISCOVERY

Figure 1:
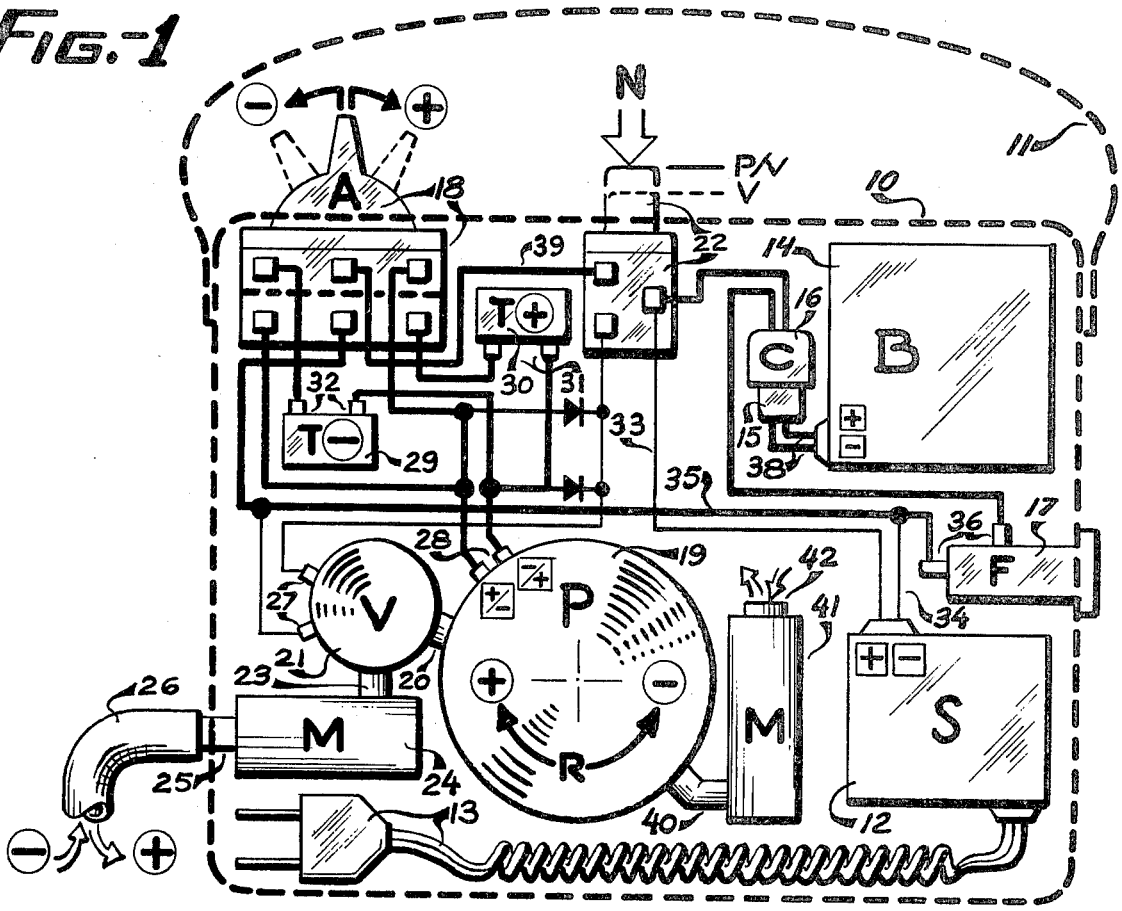

This invention relates as an improvement over earlier U.S. Pat. No. 3,608,961 (Filed-9/69) by the Inventor hereof, since it has now been proven to enhance the general contouring capability of the earlier said invention entitled "Variable Contour Cushion" which purpose was to also serve in neutralizing body pressure fatigue points for maximum seating comfort.

While the said earlier patent described a cushion which gave substantial results in claim to the employment of a negative air-pressure differential condition in one operational mode state, with a biasing to an alternate atmospheric mode state allowing cushion contours to be transformed from the former said fixed state into a compliantly supple state; difficulty was encountered in obtaining consistantly good results in negating pressure-points among random users of production specimen cushions. Hence, it is the purpose of this disclosure to set forth an improved version of the earlier patented variable-cushion operating means.

An on-going policy of research & development by the Contourmatix Seating Company of San Diego, Calif., exclusive Mfg. & Mkt. organization for said invention, has resulted in excellent progress toward a truly advanced seating innovation destined to achieve wide acceptance among a diversity of the public. The major sales market is projected among motorists, pilots, truckers, wheelchair users, and quality air & surface transportation commercial seating; plus, somewhat less dynamic installations such as for dental offices, auditoriums, and business offices. Some of these uses define conditions where persons are confined to sitting for long hours, and pressure-points existing in conventional seating can lead to real physical hardship. It has been recognized for some years now that to achieve a neutralizing of pressure-points and true posture-pedic body support are the critical factors in obtaining and maintaining seated operator efficiency, and it is now acknowledged that work related task stress factors can be amplified to an acute level when physical duress of improper seating is present.

Hence, scientific seating pressure test studies were conducted through use of a special inflatable spot pressure-sensor device placed between the seated person and the specimen cushion, with a small diameter air-line communicating from the sensor to a nearby pressure-guage reading in PSI, and also in communication with a simple hand squeez-pump equiped with a check-valve and needle-valve (which may be opened to bleed to ambiency). This rig has enabled a trained observer to comparatively evaluate seating pressures by virtue of an indicating signal-lamp which illuminates when a manually pumped-up line pressure of as much as 100-PSI is released slowly until the metalic coated inside surfaces of the said sensor-pad just make contact and complete an electrical circuit to said signal-lamp. Armed with this controled proceedure, the Contourmatix developers have been able to fully analyze performance of both conventional seating versus what should be referred to as early Phase-I cushion operational techniques; and, have extrapolated data which confirms the Phase-II system as being an important advancement in the Contourmatix state-of-art. Using both the latest in Contourmatix cushion construction and the newly revealed Phase-II "floative"-mode of cushion operation, remarkably consistant low seating pressure readings of around 18-PSI at the particularly difficult Ischilary bone region of the buttocks were recorded; while in contrast, the Prosthetics Specialist's at the U.S. Gov'mt. V.A. Houspitals have reported readings among conventionally seated wheelchair patients as high as 100-PSI. Since a good portion of the Vet. Admin. Hospital's many wheelchair patients are paralytic in the lower torso region, and hence cannot feel potentially harmful seating pressure-points, this often leads to occurance of Decubitus Ulceration of the skin, especially at the critical Ischilary region; and the patients misery is eventually complicated by need for remedial surgery which can cost $15,000 in medical expenses. Such extreme cases are cited here to exemplify the threat of poor seating, and owe to the importance of subtile refinements in precluding the presence of dreaded seating pressure-points; while retaining the basis simplicity of the Contourmatix system.

Having explained the background of the Contourmatix seating system, and purpose for this disclosure, it is now appropriate to define the basic Modes of cushion operation and improvements thereof.

In the identified U.S. Pat. No. 3,608,961, it was demonstrated how air encapsulated within the molded closed-cellular structure of each EPS/Expanded-polystyrene micro-bearings provided, in essence, a readily distortable micro-baloon having a thermoset memory; said micro-bearings respond in plurality during a relaxed cushion pressurization condition (the imperforate casement is internally equalized with the ambient-atmosphere) by merely rolling about in the manner of ball-bearings. This natural state of cushion condition is referred to now as the "neutral"-mode, and is actually now an interim — stage between two extreme modes of pneumatic operation. Formerly however, this Neutral-mode was one of two designated modes, the other remaining unchanged; while it has been determined the simple expediency of bleeding to ambient-atmosphere to attain full cushion compliance cannot alone provide the consistantly reliable contouring capability required by the demanding user.

According to the original said patent, the freely encased micro-bearings individually but simultaneously alter from their natural round formation, into multi-fasceted polyhedrons in a progressive manner as the level of internal casement fluidic-pressure is lowered relative to the prevailing ambient-atmosphere; and the resultingly immense compressive wall loading upon the resilient casement acts to accordingly compress its contents. No longer round and rolling upon one another, the thus deformed micro-polyhedrons press against each other in growing intimacy proportionate to the air-pressure differential effect. This altered state achieves a substantially nonpliant state of cushion compliance at about 3-5/PSI-negative pressure differential (aprox. 8½ inches Hg. Vac) and is now refered to as the "Conform"-mode of usage. Because of their closed poly-cellular composition, these favored EPS/micro-bearings further perform partly by virtue of encelled gas acting in compression as a pneumatic spring, and partly as said through thermoset plastic memory, to faithfully return to their natural round formation whenever cushion casement internal-atmosphere is restored to equalibrum with ambient-atmosphere; this restoration being acomplished through means of a valve biasing to create fluidic communication in the form of a brief decompressive bleed-down toward the ambient direction, or, a positive air pumping source may be employed which relates to yet another operational mode.

It has been discovered, that by inducing positive air within the said cushion casement confines to a very limited degree (aprox. one-PSI max.), that an additional "floative"-mode of operation is created; wherein the seated person is pneumatically elevated slightly above the said EPS ingredient by force of a positive-differential over the ambient-atmosphere. Pressure-point testing under a variety of conditions has shown this newly disclosed floative-mode works to enhance Contourmatix cushion contouring by virtually freeing liberating the said EPS/micro-bearings from the retarding friction of one's body weight upon the said casements upper-surface; thus freed, the said micro-bearings then respond by easily flowing about to points of least resistance before the internal positive pressure is subsequently evacuated. While the floative-mode is intended primarily as a brief operation in obviating need for occupants to exert a "squirming" body motion briefly, as was found to be necessary with the prior invention, it should be noted that some users find that the floative-mode enables them to gain a mild massage effect by utilizing the slightly mushroomed casement condition under the positive pressure to induce a rolling action for a few moments when confined to sitting for long periods. However, as stated, the key function of the floative-mode is to enable the EPS ingredient (aprox. 1/64th to 1/16th of an inch in nominal diameters) to be easily displaced in a flowing manner as the seated individual is again lowered to rest securely out of floative-mode by venting to ambient-atmosphere in bleed fashion or through action of a relatively small electric powered air-pump; in either manner of air flow, a valving means must be included in order to block or check flow of fluid in or out of said casement of a slective basis.

Because in most seating environments no suitable provision for both negative and positive air exist, Contourmatix Company has developed various types of air inducing equipment commonly refered to as the "energizer" apparatus, which proprietary configurations vary from that of a manually operated version to a fully automated electrically powered unit, both of which are entirely portable. In Contourmatix systems where it is desirable to engineer in the utmost operating efficiency, the fluidic flow check-valves are arranged so as to permit a bleed-down of either positive or negative air pressure differential within the casement to that of ambient-atmosphere, rather than require an induced pumping out of either fully energized operational modes; thus conserving either battery power or physical effort.

Hence, in summation, it is an object of this invention to provide a variable-cushion operating system through which expansion-force of a positive air-pressure (above that of ambient-atmosphere) adds a more lithely compliant conditioning of said cushion in order to bouyantly counterpoise occupant weight thereon; and thus facilitate a more faithful reproduction of the occupants posterior into the cushion upper surface.

It is another object of this invention to provide a variable-cushion operating mode which results in greater controlability over cushion surface compliance, between extreme mode conditions.

It is another object of this invention to provide a variable-cushion having a combination of operating modes resulting in a more responsive contouring of the cushion surface, thereby obviating need for occupant thereof to assist the contouring process by employment of body squirming proceeding the Contour-mode.

It is another object of this invention to provide a variable-cushion operating mode which is an interim point of energizing between positive and negative mode extremes, thereby offering the user an extended range of cushion compliance from ultra-soft to firm, respectively.

It is another object of this invention to provide a variable-cushion energizer having a valving system which obviates need for excessive pumping action by virtue of an expedient bleed of either negative or positive cushion pressure into the ambient-atmosphere, whereupon pumping action may resume to again restore a cushion pressure differential in one of extreme opposite modes if desired.

It is another object of this invention to provide a variable-cushion operating means which affords the user the convenience of transforming a semipliant cushion in the Neutral-mode, to an inflated air-cushion in the fully energized Floative-mode; thus enabling the user to administer a kind of self-massaging to further stimulate blood circulating in the posterior region.

It is another object of this invention to provide an optional energizing apparatus to function in accordance with the affore said provisions, wherein is included an electric powered reversible-flow air-pump activated by a double-pole/double-throw momentary switch which also simultaneously activates a normally-closed solonoid actuated two-ported air-valve; said valve installed between said pump and the subject cushion, with provision to activate the valve without activation of pump, thereby facilitating a sequencing of either extreme mode differential condition to the Neutral-mode via bleed-down.

With the foregoing objects in mind, other features of importance shall become apparent as this text proceeds, and the following specifications taken in conjunction with the accompanying drawings; wherein like characters of reference are used to designate like parts, and wherein:

FIG.-1 is a diagramatic representation of an exemplified variable-cushion Energizer-unit, wherein are arranged for greatest clarity the basic electro-pneumatic componetry indicated via alphabetical callouts. Also presented are the pneumatic circuit's positive (+) and negative (−) operational modes shown within small circled places; and, the electrical circuit's positive (+) and negative (−) current outputs, within small squared places. All electrical circuitry wiring is indicated by a solid line, and only points of intersection reinforced by a heavy solid dot thereon constitutes a circuit connection.

Figure 2A:
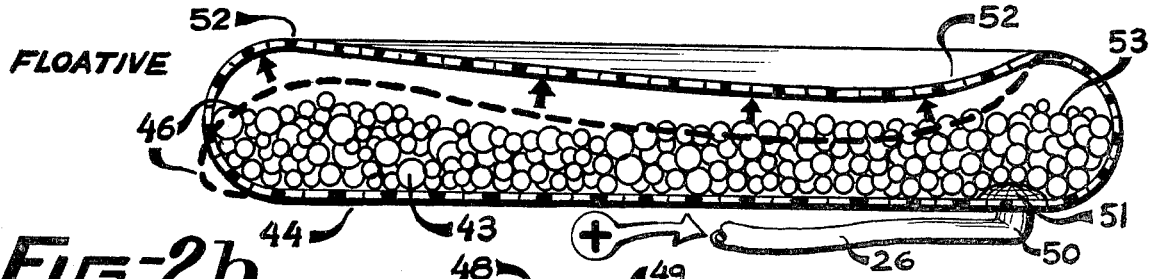
Figure 2B:
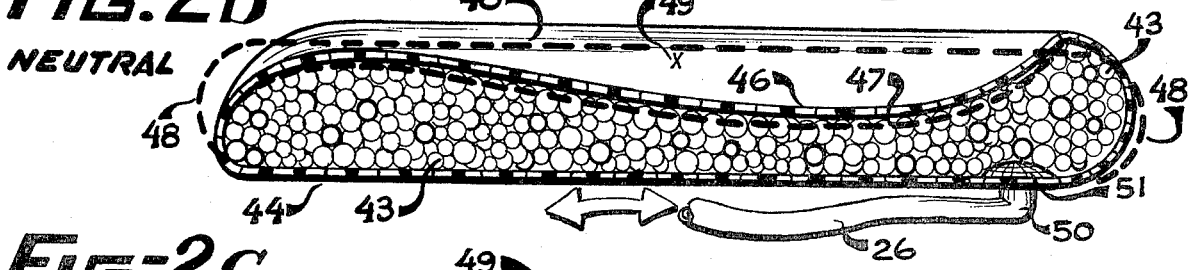
Figure 2C:
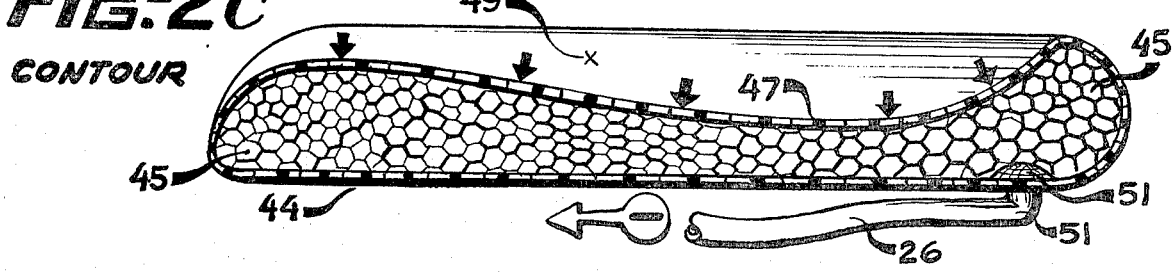

FIGS.-2*a* 2*b* and 2*c* are arranged in three successive stages of basic operational modes, revealed in side cross-section as viewed down the exemplified variable-cushions longitudinal central plane; with broken-line overlay thereon indicating the contour position of an adjacent mode sequence to allow direct comparison of mode effects upon the contour.

Therefore, in conjunction with the preceeding descriptive enumerations, reference is given to the elements of FIG.-1, wherein is exhibited the preferred embodiment of a fully portable variable-cushion Energizer-unit which componentry is substantially confined within case borders 10 except for the carrying-strap 11 thereto. In using this special apparatus for the purpose of energizing the several modes of variable-cushion function, it shall be considered that while a portable unit is herein characterized, other similarly performing permanent installations may be restored to by simple ommission of those components such as the (S)stepdown-transformer 12 which acts to drop 110V.AC Line-current from cord & plug aggragate 13 down to only 12V.DC/6Watts, thereby serving as an overnight charger for sealed type storage (B)battery 14 which is the prime power-supply for the Energizer, and connects into the main circuit via standard biforcated male/-female (C)connector aggragations 15/16 respectively.

Safeguarding the entire electrical circuit is an externally accessable (F)fuse-holder 17 having series terminals 36 through which negative current is fed to the main (A)actuator-switch 18. Because of the need to realize both neg. & pos. air pressure sources, the Inventor has devised a simple means of adapting an essentially standard rotary-vane compressor having internal pumping stators arranged radiating directly outward from an eccentric central-axis; which in conjunction with a conventional permanent-magnet type 2-brush D.C. drive motor creates either of said air-pressure sources by virtue of said pump/motor unit being selectively reversible, thereby uniquely obviating usual requirements for a much more complex valving arrangement common to reciprocating type pumps for example; and the said rotary stator-vanes being centrifugally sealed against the attendant cylinder-wall during pump activation, conversely tend to release from the said cylinder-wall chamber when deactivated, thereby uniquely serving to obviate need for an additonal bypass-valve during the special Neutral-mode bleed-down sequence of operation. Hence, said electrical-pump unit 19 exhibits the reference letter "R" with adjacent directional arrows indicating the resulting air driven through fluid connector 20 to or from (S)solenoid-valve 21 which is a standard cylinderical valve-body of 2-ported/normally-closed configuration having a coil actuated plunger. Included in the electrical circuit to said valve 21 is a separate switching function reference "N" which is shown seperate from the main actuator switch 18 for reason of both disclosure clarity and the fact that it would require a special switch construction having a progressive two-stage switching action in both extreme mode directions suggested by adjacent arrows. To further explain, it is seen that to depress switch 22 allows the valve 21 to "open" thereby allowing a free-flow of either neg. or pos. air-differential condition as may be then prevailing, through fluid-connector 23, air noise attenuation (M)muffler 24, and external-outlet connector 25 to which is shown a brief section of ordinary flexible air-hose 26 which is of sufficient length to reach the variable-cushion without stress. In those installations where the Energizer package 10 would be integrated into a chair such as a secretarial chair for example, the flexible line 26 could be a rigid conduit feeding directly into the subject variable-cushion.

There are two objectives in arranging the optional said Neutral-mode switch 22 in the foregoing manner; one being to electrically bias the circuit from the actuator 18 thereby averting any occurance of short-circuiting the system electrical polarities which could result in damage to said respective switches if simultaneously actuated. The primary objective is however, to permit activating said valve 21 without activating pump 19, thus substantially conserving battery power since the flow rate of the cushions self induced pressure-bleed is effectively equal to that of said pump, and quieter as well. Naturally, use of actuator 18 will have to be ushered in as the air-differental within the variable-cushion becomes neutralized, as when an opposite mode from that just negated is desired for example.

Note also in FIG.-1, that electrical connector terminals 27 are interchangable when switch 22 is in P/V-position, since the D.C.-solonoid coil at 21 accomodates polarity reverse. Note also, that pump 19 exhibits two small boxes wherein are referenced the relative electrical polarities for similarly reversible terminals 28; and, switch 22 has three terminals of which the right-hand one is the common switching-pole thereof. The main actuator switch 18 is shown as a standard double-pole/-double-throw center self-canceling type, having sufficient capacity as to negate need of a separate switching relay to handle current flow. Also revealed in FIG.-1 is the manner of circuitry arrangement upon actuator switch 18 which facilitates descrete circuiting of respective (T)timer-modules 29 and 30, each of which are essentially standard automotive type circuit-breakers but of differing amperage rating, thereby performing their tasks as timers to effect an "open-circuit" when a predetermined period of energizing in a given mode has been reached, thereby automatically defeating any excessive use of the battery or pump members by the novice user; said timers being internally comprised of a simple bi-metalic strip which distorts to cause a temporary circuit interuption, but will cool in a few seconds so as to automatically reinstate a "closed-circuit" although still warm will cycle more quickly to effect short bursts of pump 19 action if the user so persists. Operation in the Conform-mode normally requires about twice the approximate 5-second duration of pump 19 run of Floative-mode operation. It is also worth mention that timer terminals 31 and 32 may be connected to their respective shunt circuits without regard for orientation of terminals thereof.

Other features of FIG.-1 circuiting include electrical conductors from the said stepdown-transformer 12 which serves to recharge battery 14 via light-guage wire members 33 which is the positive conductor, and like wire 34 the negative conductor which ties into heavy-guage conductor 35 passing through fuseholder terminals 36; and, it is required that the said leads 33/34 be match polarized with battery leads 38. The electrical conductor 39 eminating from the single-pole/double-throw momentary action switch 22 feeds to the common "hot" terminal on switch 18, said switch being shown divided via broken-line to make clear the three aligned terminals of each pole thereof; and said conductor 35 likewise connects to the common central terminal of the lower divided half of said switch, which acts to complete the negative side of the circuit already discussed. Elsewhere, the ambient-air fluid connector 40 is also a source of pump howl, so an additional (M)muffler 41 is included along with arrows at the ambient aperature 42 which merely refer to the reversible pumping capability.

With the features of FIG.-1 in mind, reference in now given to the exemplified seat cushions of FIG.-2, wherein all three basic operational modes are displayed in side cross-sectional view. Because the Neutral-mode is the naturally relaxed state of the variable-cushion, the explaination shall commence with the central view; and for sake of clarity the seated occupant has been rendered invisible, leaving only the resultant contour depression of the phantom occupant. Thus, it is seen that the EPS-ingredient 43 is in a natural and hence substantially round condition within imperforate casement 44, but still subjected to the weighted compression of the occupant which imposes a theoretical pressure of about 1½-lbs/sq.in., a lot less than the approximately 7½-lbs/sq.in. which is imposed on the cushion by ambient atmospheric pressure-differential when energized in the Conform-mode to about 15 inches Hg. negative pressure. But there remains a considerable degree of inter-surface friction tending to retard the easy rolling performance of EPS-microspheres when the weight of said occupant remains versus when the occupant leaves the cushion during Neutral-mode, and this is the problem which is to be remedied by introduction of the Floative-mode, since it is now obvious that ambient-atmospheric bleed alone cannot offset or negate the friction inducing effect of the occupants own weight.

Study of the Conform-mode at the bottom of FIG.-2 displays how the normally rounded micro-bearings tend to take on their temporary transformation into polyhedrals 45 by virtue of the crushing accumulative atmospheric loading of over 1½-Tons upon an average size seating cushion, in addition to the above mentioned occupant weight. As stated earlier, the unique closed-cellular structure of the preferred variable-cushion ingredient, the EPS/micro-bearing, serves to give the polyhedral like entity an instant memory in resuming its natural round shape in a progressive manner in proportion to the degree of air-pressure differential transition. Note how the surface delineation 46 of the Neutral-mode actually shrinks away to position 47 of the Conform-mode to illustrate the effects of compression; while in a totally relaxed condition without presense of an occupant thereon, the same cushion surface may take on the natural contour as delineated by broken-line 48 as further comparison. Naturally, the myraid EPS-micro-bearings would have somewhat reoriented themselves to achieve the exhibited obliteration of surface contouring suggested by said line 48, but there is such a low degree of micro-bearings inter-friction in Neutral-mode without an occupant that the casement 44 itself can act to oppose any inherent tendency it may have toward flatness as it were. Also seen in the views is the desirably high side wall 49 of the typical variable-cushion, which serves to attain the overall support of the occupants body desired by seating experts.

In the Floative-mode view of FIG.-2 is demonstrated just how the heretofore problem encountered in achieving reliable and repeatably precise contouring operation was overcome. Notice that the arrowed plus-symbol tells of air entering the cushion through the hose 26 elbow 50 and micro-bearing retention filter 51, to act within said cushion-casement to buoy-up in effect, the occupant thereon, thereby relieving the micro-bearings of any impeding frictional loads other than their own weight, (which is extremely light), having a negative specific-gravity. As the occupant is thus buoyed to the temporary surface position indicated by broken-line delineation 52 from surface 46, the myraid micro-bearing ingredient tends to flow to a common level 53 whereupon the air entraped within the casement by normally-closed valve 22 in FIG.-1 again is sequenced to open thereby lowering the occupant upon the myraid micro-bearings 53 which readily displace toward the regions of least resistance, until no further air cavities remain within the cushion, and a resumption to a precise contour such as is exemplified by delineation 46 is reproduced. Thus, it is now obvious that the newly revealed energizing sequence of operation offers considerable improvement in 3-D contouring, which makes the production of reliably performing variable-cushions a reality.

While various types of energizing apparatus may be resorted to in the process of obtaining the improvements herein revealed, this invention is not to be limited by the embodiment shown in the drawings or described in the text, which has been given by way of example and not of limitation; and, shall apply to all manner of contouring to the human for support thereof without pressure-points.

I claim the following:

1. Cushioning of the variable-contour body-molding type comprising a resilient imperforate casement containing a myraid quantity of deformable micro-bearings, as characterized in the following improved conditions of operation (A.) floative-mode, an expansive state created by selective means inducing a positive fluidic pressure-differential serving to bouyantly counterpoise occupant thereupon, enhancing subsequent conformability by eliminating excessive micro-bearing frictional resistance to an otherwise propensity toward flowing to points of least bodily resistance, preparing an advanced state of conformability heretofore unknown;

(B.) neutral-mode, a semi-formable state created by selective means inducing ambient fluidic pressure to neutralize either differential effect, wherein a substantially spherical micro-bearing shape is represent but achieving a retarded rolling propensity due to friction impossed by weight of occupant thereupon, thereby exhibiting mild compliance as an interim mode of operation;

(C.) conform-mode, a compressive state created by selective means inducing a negative fluidic pressure-differential serving to impose a substantially polyhedral micro-bearing shape, resulting in high frictional interlocking of micro-bearing surfaces which en masse resist further cushion surface change, hence, fixing an instant body mold of the occupant.

2. Apparatus according to claim 1, wherein said means essentially comprises a valve having an outlet in fluid communication to within said casement, and an inlet in fluid communication with an appropriate fluid-pressure source, said source employing adjustable fluid-pressure biasing means by which to induce the desired degree of selected positive or negative fluid-pressure relative to an ambient pressure norm.

3. Apparatus according to claim 2, wherein said fluidic-pressure source comprises a reversible flow Rotary-vane or equivalent type fluid pump, obviating complexity of reversing pump inlet/outlet ports, as is the customary means; whereby cushion compliance may be adjusted merely by nature of directional pumping action only, not by cause of juxtaposition switching of inlet/outlet ports; and, natural blow-by action of the inactive(relaxed) said pump vanes, further obviates need for a by-pass valve during the optional casement bleed-down sequence of operation.

4. Apparatus according to claim 1, wherein selective means comprises a valve having an outlet in fluid communication within said casement, and a fluid pressure inlet which may be descretely biased between any of specified fluidic sources:

(A.) a positive-pressure as measured relative to ambient casement atmosphere...

(B.) a neutral-pressure as measured relative to ambient casement atmosphere...

(C.) a negative-pressure as measured relative to ambient casement atmosphere.

5. Apparatus according to claim 1, wherein negation of either said florative or conform operational-modes may be expediently employed to obviate excessive pumping action, by biasing the fluidic inlet in communication within said casement, directly into fluid communication with the ambient atmosphere; with resulting rapid bleed-down action.

6. Apparatus according to claim 5, wherein said Rotary-vane pump is power driven via electric-motor, and reversibly controlled, stopped & started, via use of a double-pole/double-throw/normally-open to center electrical switch; serving to electrically reverse polarity excitation of said driving-motor in selective manner.

7. Apparatus according to claim 6, wherein said pump driving-motor is automatically timed to a limited duration of predetermined energizing action, by means of an electrical amperage-current flow measuring type of sensor device in form of an essentially standard automotive circuit-breaker; said sensor being preset to a given resistance and connected in-line with one of series-circuit conductors, so as to monitor and effect an appropriate, open-circuit, to thus notify user that full mode energizing has been attained.

8. Apparatus according to claim 4, wherein said valve is an essentially standard 2-way/normally-closed selonoid actuated type.

9. Apparatus according to claim 1, wherein said micro-bearings are a closed-celled plastic type, such as expanded-polystyrene/EPS.

10. Apparatus according to claim 1, wherein each said characterized mode selection is held in check within said casement once so energized, by valving-off fluid-communication to any of said fluidic pressure sources; thereby negating need for continuous fluidic attachment to said pressure sources, resulting in conservation of pumping energy, and ultimate portability in the Conform-mode of operation.

* * * * *

UNITED STATES PATENT OFFICE

CERTIFICATE OF CORRECTION

Patent No. 4,114,214 Dated September 19, 1978

Inventor(s) Robert Von Heck

It is certified that error appears in the above-identified patent and that said Letters Patent are hereby corrected as shown below:

In the Drawings, Fig. -2C, the term shown as "CONTOUR" should read -- CONFORM --.

Column 4, line 2, "Contour-mode" should read -- Conform-mode--.

Column 10, line 12, "expanded-polystyrene/EPS" should read -- EPS/expanded-polystyrene --.

Signed and Sealed this

First Day of May 1979

[SEAL]

Attest:

RUTH C. MASON
*Attesting Officer*

DONALD W. BANNER
*Commissioner of Patents and Trademarks*